United States Patent [19]

Forward et al.

[11] 4,135,642

[45] Jan. 23, 1979

[54] WIPER ARRANGEMENT FOR TONER LEVEL SENSOR

[75] Inventors: John E. Forward, Penfield; George A. Muller, Pittsford; Douglas P. Connolly, Webster, all of N.Y.

[73] Assignee: Xerox Corporation, Stamford, Conn.

[21] Appl. No.: 802,748

[22] Filed: Jun. 2, 1977

[51] Int. Cl.[2] ..... B41F 31/06

[52] U.S. Cl. ..... 222/23; 222/DIG. 1; 350/61

[58] Field of Search ..... 350/61; 222/23, 64, 222/66, DIG. 1; 118/7, 9

[56] References Cited

U.S. PATENT DOCUMENTS

| | | | |
|---|---|---|---|
| 3,409,901 | 11/1968 | Dost et al. | 222/DIG. 1 |
| 3,475,859 | 11/1969 | Pirlet | 350/61 UX |
| 3,498,500 | 3/1970 | Hanson | 222/23 |
| 3,596,807 | 8/1971 | Hudson et al. | 222/DIG. 1 UX |
| 3,834,806 | 9/1974 | Whited | 222/DIG. 1 X |
| 3,844,661 | 10/1974 | Birkett et al. | 350/61 X |

*Primary Examiner*—David A. Scherbel

[57] ABSTRACT

A toner dispenser having a rotatable cylindrical dispenser roll and an automatic low toner level indicator comprising a lamp and photocell mounted in opposed walls of the dispenser adjacent the bottom of the dispenser housing. The lamp and photocell are separated from the toner in the dispenser by transparent windows. A wiping arrangement is provided inside the dispenser to periodically clean the windows including wiper pads biased into contact with the windows and movable periodically back and forth across the surface of the windows in response to rotation of the dispenser roll.

7 Claims, 4 Drawing Figures

WIPER ARRANGEMENT FOR TONER LEVEL SENSOR

BACKGROUND OF THE INVENTION

This invention relates to toner dispensers for electrostatic copiers and duplicators and more particularly to detectors for warning a machine operator of impending exhaustion of the toner supply.

Conventional electrostatic copiers and duplicators use an electroscopic toner to develop latent electrostatic images from which copies are made. This toner is consumed in the copying process thereby periodically depleting the toner supply. When the supply of toner finally nears exhaustion, there may be a perceptible reduction in the density of the developed image and therefore, a corresponding degradation in copy quality. This latter condition is usually the first indication that the toner supply is in need of replenishment. A knowledgeable operator will, of course, add additional toner upon noticing that the density of the copied image has decreased, but several substandard copies may be made before that happens.

Accordingly, it has been recognized that an earlier warning of impending toner exhaustion would be desirable. One approach to solving that problem has been to use a transparent toner dispenser so that light emitted by a lamp at one side of the dispenser is visible at the other side when the toner supply drops below a predetermined level. Alternately, a light source on one side of the dispenser may be located to illuminate a photodetector on the opposite side of the dispenser to provide an indicating signal upon a preselected depletion in the toner level. This latter arrangement has been undesirable since the photocell housing may become coated with toner powder and will therefore not be activated properly upon the drop in toner below the preselected level.

The present invention is directed to the latter type of system in which both the lamp and the photocell are separated from the toner supply by transparent windows and a provision for periodically cleaning or wiping these windows is provided.

OBJECTS AND SUMMARY OF THE INVENTION

It is therefore a primary object of this invention to provide an improved toner dispensing arrangement for use in electrostatic machine.

Another object of the invention is to provide a toner level alarm arrangement which automatically provides a signal to a machine operator when the level of toner in a dispenser drops below a preselected level.

Yet another object is the provision of a toner level indicator which overcomes the disadvantages of the prior art.

A still further object is the provision of a toner level indicator of the above noted type which utilizes a photoelectric arrangement in which the lamp and photocell of the arrangement are separated from the toner by transparent windows which are periodically wiped and cleaned by a wiper arrangement driven from the toner dispensing roll.

These and other objects of the invention are accomplished by providing a toner dispenser generally of the type disclosed in U.S. Pat. No. 3,596,807 in which an open-celled resilient foam dispensing roll rotates in an elongated opening in the bottom of a toner dispensing reservoir to dispense toner by gravity to a development housing. There is provided in the dispenser housing on opposed sides directly opposite each other a lamp assembly and a photocell assembly, each of which includes a transparent shielding window which separates the interior of the assemblies from the toner supply. A wiper assembly is provided which operates in response to the rotation of the dispensing roll to periodically clean and the transparent shielding windows of toner which may accumulate on the surface thereof.

BRIEF DESCRIPTION OF THE DRAWINGS

The novel features and advantages of the present invention will become more apparent after reading the following description which refers to the accompanying drawings wherein.

DESCRIPTION OF THE PREFERRED EMBODIMENT

The toner level indicator of the invention will be described as being incorporated into a toner dispenser of the type shown in U.S. Pat. No. 3,596,807 although various other dispensing arrangements may be used in conjunction therewith.

Figure 1:
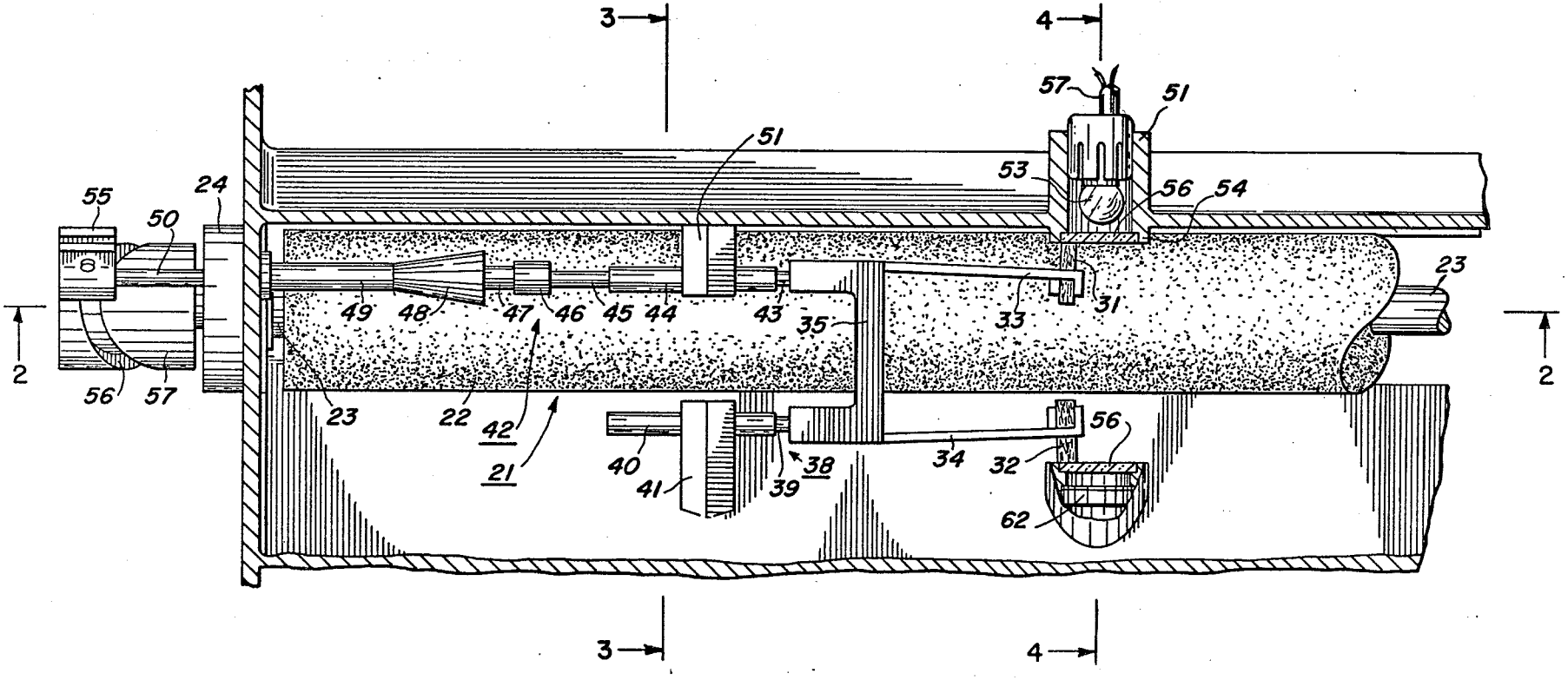
FIG. 1 is a plan view, partly in section, of the toner dispenser housing, and photoelectric sensing arrangement showing the wiper arrangement of the invention incorporated thereinto.
Figure 2:
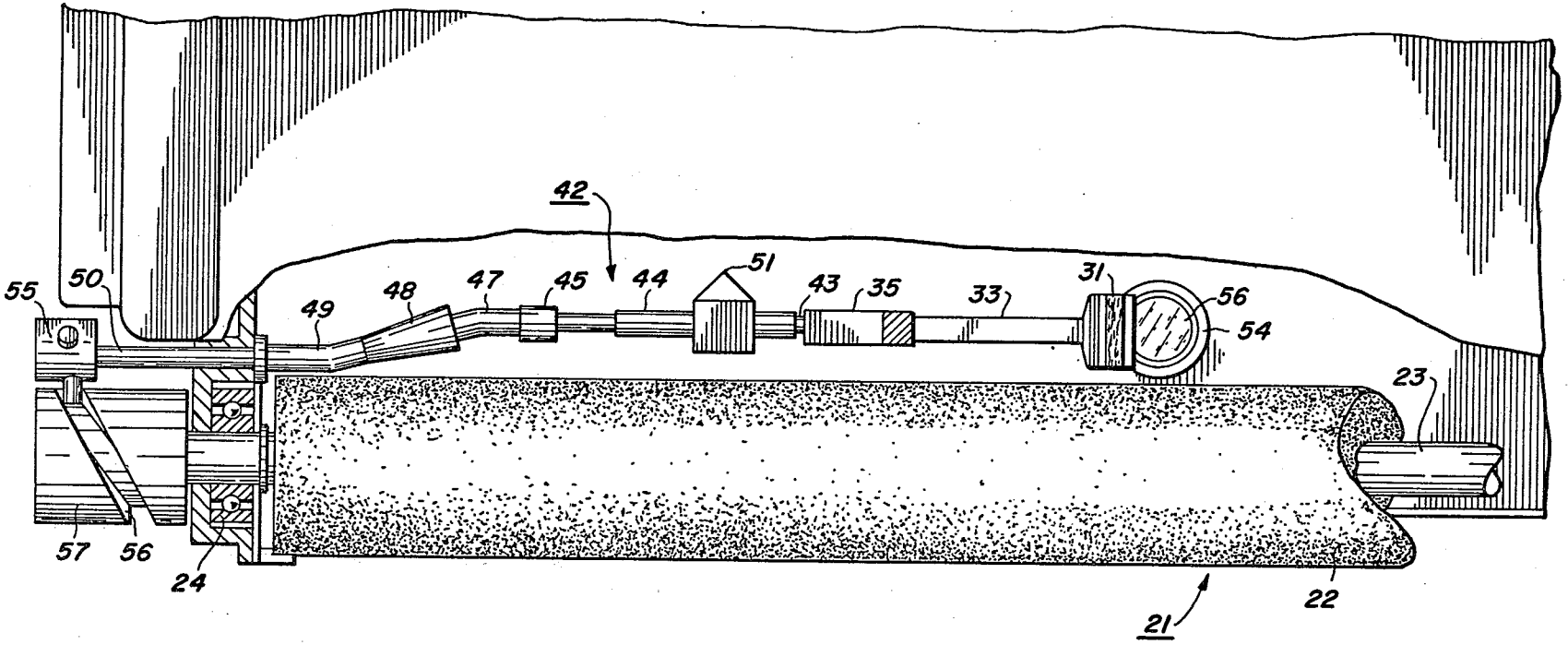
FIG. 2 is a elevation view, partly in section, taken on the lines 2—2 of FIG. 1.
Figure 4:
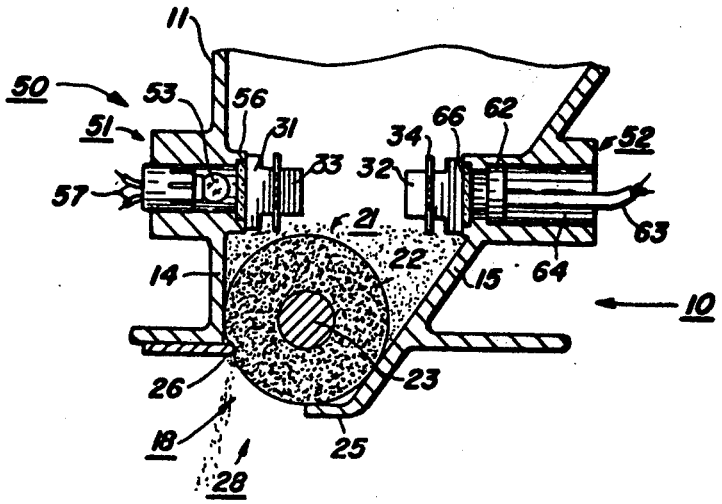
FIG. 4 is an elevation view taken along the lines 4—4 of FIG. 1.
Figure 3:
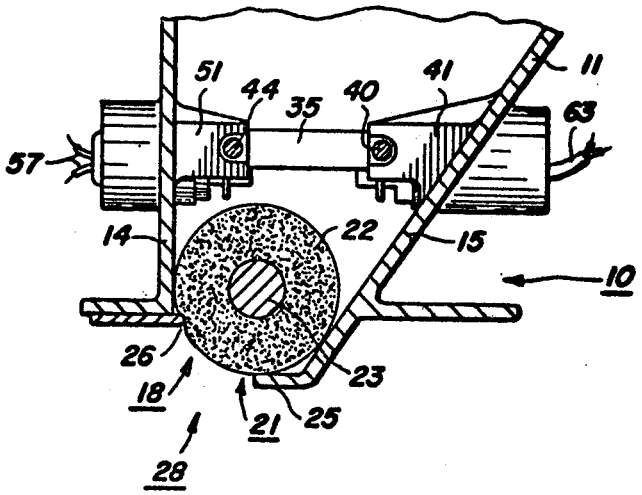
FIG. 3 is a cross-sectional view taken on the lines 3—3 of FIG. 1.

In order to set the environment into which the invention may be incorporated a brief description will be given of the aforementioned dispenser as follows:

Referring to FIGS. 3 and 4, the toner dispensing unit 10 (only the dispenser opening portion shown) includes a hopper 11 having two sidewalls 14 and 15 closed by end walls (not shown) to form a generally four sided reservoir substantially triangular in cross section.

The bottom portions of the sidewalls 14 and 15 are spaced apart to form a dispensing opening 18 in the bottom of the hopper 11. The sidewall 15 is inclined to direct toner in the hopper by gravity toward the dispensing opening 18.

The dispensing unit 10 further includes a dispensing roll assembly 21 constructed in accordance with the teachings of U.S. Pat. No. 3,596,807. The roll assembly 21 includes a cover 22 securely affixed to a shaft 23, as for example, by gluing, and the shaft is journaled for rotation in bearing blocks 24 (only one shown) provided in the lower end walls of the hopper 11. One end of shaft 23 extends through one end wall (not shown) of the hopper for coupling to a suitable drive means (not shown) to rotate the shaft 23.

The dispensing cover 22 may be formed from any number of foamed elastomeric materials having a textured open-celled surface structure made up of a mass of small hollow cavities capable of receiving and supporting a quantity of particulate material therein. Typical examples of foamable materials that can be formed in open-celled configurations are polyurethanes, polyvinyl chloride, silicones, polystyrenes, styrene acrylonitrile, cellulose acetate, and phenolics. A typical cover for use in the preferred embodiment of the present invention is one fabricated of a urethane foam.

The sidewalls 14 and 15 of the hopper 11 further form two flanges or bosses 25 and 26 which abut the periphery of the cover 22 to ensure uniform toner dispensing across the width of the developer housing. The trimmer boss 25 ensures that the pores of the foam roll cover which are filled during rotation through the toner do not carry an excessive amount of toner. The dispensing boss 26 applies pressure to the cover forcing the trapped dry ink to leave the roll and fall by gravity into the developer sump. The operation of the bosses 25 and 26 in deforming the surface of the roll cover to load and unload toner is described in greater detail in the aforementioned patent.

In operation, as the foam roll 21 is rotated, the toner in the hopper 11 is continuously loaded into the pores of the cover 22 on the hopper side of the roll, leveled by the trimmer boss 25, and forced to be expelled by baffle 26 on the developer sump side 28 of the roll.

The automatic toner level sensing arrangement 50 is located generally vertically above the roll assembly 21 and includes a light source or lamp unit 51 and a photocell assembly 52. The lamp assembly 51 includes a light source 53 which may be a conventional incandescent bulb or light emitting diode or the like. The light source 53 is held in a holder or socket 54 which is mounted in a suitable opening in the sidewall 14 of the hopper 11. The opening being covered on the inside by a light transmitting window 56. Suitable electrical leads 57 are coupled to the assembly 51 for energizing the source.

The photocell assembly 52 is mounted in the opposite sidewall 15 of the hopper at approximately the same vertical height as the lamp assembly 51 so that light from the source 53 may pass into the photocell assembly 52. The assembly 52 comprises a photosensor element 62 to which is coupled electrical leads 63. The photocell element is carried in a holder or socket 64 mounted in a suitable opening in the sidewall 15, the opening including a light transmissive window or shield 66 which closes the interior of the opening and separates the toner contained in the hopper from the element 62.

It is apparent that when toner in the hopper 11 rises to a level above the photocell and light assemblies, the light emitted by the source 53 will not be detected by the photocell element 63 due to blockage by the mass of toner in the hopper. However, when the toner level drops below that of the photocell and light assemblies the light from the lamp will pass unimpeded and activate the photocell which results in the generation of an electrical control signal indicative of the drop in toner below a preselected level. The electrical signal could, of course, be used to control the activation of a light or other visual indicator by which the operator would be informed of the need to replenish the toner in the machine.

Such low toner indicating assemblies of the prior art have the disadvantage that the windows 56 and 66 which operate to shield the lamp and photocell from contamination by toner, themselves become contaminated. This is an even more acute problem during high humidity conditions when toner tends to adhere to adjacent surfaces more easily. Under such conditions, the windows 56 and 66 may become darkened with toner to the extent that light from lamp 53 does not reach the photocell 62 even after the toner has dropped vertically below the level of the units. The invention proposes a wiper arrangement to prevent the above condition by periodically cleaning the windows 56 and 66.

The wiper arrangement of the invention is made up of wiper pads 31 and 32 associated with each of the transparent windows 56 and 66. The pads are made of any suitable soft rubber or plastic material which are sufficiently hard to remove toner material from the windows when wiped thereacross without excessive streaking. Urethane foam pads were found to operate best. The pads 31 and 32 are mounted in resilient arms 33 and 34 respectively so that their wiping edges are parallel with the glass windows 56 and 66. The arms 33 and 34 are in partly loaded condition to exert a continuous force on the pads in the direction of the windows 56 and 66. This latter action fosters efficient cleaning of the windows.

The arms 33 and 34 are jointly carried by a U-shaped bracket 35. A first substantially rigid linkage assembly 38 comprising links 39 and 40 extends from the side of the U-shaped bracket 35 associated with arm 34. Link 40 is mounted for reciprocal movement in a bearing 41 fixed to side wall 15 of the dispenser hopper 11. A second substantially straight line rigid linkage assembly 42 is coupled to the side of the bracket 35 associated with the arm 33. Linkage assembly 42 comprises links 43–50. Link 44, in a manner similar to link 40, is mounted for reciprocal movement in a bearing 51 formed in the sidewall 14 of the dispenser housing.

The link 50 of the linage assembly 42 is coupled to a follower 75 which rides in an endless groove 76 in the cam 77. The cam 77 is mounted for rotation with the dispensing roll shaft 23 so that as toner is dispensed the wiper arrangement operates continuously to clean the toner level indicator arrangement.

More specifically, as the toner dispenser roll shaft 23 rotates, so does the cam 77 and groove 76. The groove 76 is generally circular but oriented in a plane inclined with respect to the perpendicular to the axis of the shaft. This configuration of the groove 76 operates to produce a back and forth movement of the follower 75 along the axis of the shaft in response to rotation of the shaft 23.

The reciprocating movement of the follower 75, during rotation of the cam 77 is transmitted by the linkage assemblies 42 and 43 the wipers which move in a back and forth manner across the surfaces of the windows to thereby clean toner from the windows by the level sensing arrangement.

In operation, when toner in the dispenser is above the level of the light transmitted from the source 53 to the photocell 62, the light is blocked and the photocell remains inactivated. During this time period the wipers 31 and 32 are reciprocated across the surfaces of the window elements even though this action is ineffective to clean the windows, due to the high toner level in the dispenser. When, however, toner in the dispenser drops below the level of this test light beam, the photocell "sees" the light beam and generates a control signal indicating a low toner level. If toner should temporarily fog either of the windows during the time when the toner level is below the level of the beam, thereby preventing generation of the control signal, it is cleaned therefrom during the next rotation or operation of the toner dispenser shaft 23, the latter condition operating to move the wipers across the windows.

The windows 56 and 66 have been shown in FIGS. 3 and 4 as part of the dispenser walls, but it is equally possible for them to be formed as part of the holders 54 and 64, which holders are then clipped, screwed, or otherwise mounted into the openings in the dispenser housing. In this latter case, suitable seals may be carried on the holders or in the dispenser openings to prevent toner leakage.

It should be understood that the range of movement of the wipers is controlled by the contour and inclination of the groove 76 and further that the number of reciprocating movement per dispenser roll revolution may be controlled by changing the contour of the groove or the type of cam employed.

While the invention has been described with reference to the structure disclosed herein, it is not confined to the details set forth, but is intended to cover such modifications as may come within the scope of the following claims.

What is claimed is:

1. In combination with a toner dispenser including a hopper adapted to hold a quantity of toner, said hopper having an elongated opening adjacent the bottom thereof and a rotatable cylindrical dispensing roll located in said opening, a low toner level indicator arrangement comprising a light source, a photocell, said light source and photocell mounted in opposed walls of said hopper such that light from said source passes across said hopper at a preselected level above the dispensing roll, said light source and photocell being isolated physically from said toner by transparent windows, and wiper pads mounted for movement across the surfaces of said windows in response to the rotation of said dispensing roll.

2. The combination recited in claim 1 wherein said wiper pads are carried on resilient arms which continuously bias the pads in the direction of said windows.

3. The combination recited in claim 2 wherein said arms are coupled via a linkage means to a follower, said follower movable in response to a cam rotatable with the dispensing roll.

4. The combination recited in claim 3 wherein said dispensing roll comprises a open-cell foam.

5. The combination recited in claim 3 wherein said linkage means is supported on bearings formed on the opposed interior walls of the hopper.

6. The combination recited in claim 1 wherein said pads are made of a urethane foam material.

7. The combination recited in claim 1 wherein said pads move back and forth across said windows with each revolution of said dispensing roll.

* * * * *